US007122968B2

(12) United States Patent
Mas et al.

(10) Patent No.: US 7,122,968 B2
(45) Date of Patent: Oct. 17, 2006

(54) CONTROL CIRCUIT DRIVE CIRCUIT FOR A PLASMA PANEL

(75) Inventors: Céline Mas, Poisat (FR); Gilles Troussel, Grenoble (FR); Eric Benoit, Quaix en Chartreuse (FR)

(73) Assignee: STMicroelectronics S.A., Montrouge (FR)

( * ) Notice: Subject to any disclaimer, the term of this patent is extended or adjusted under 35 U.S.C. 154(b) by 829 days.

(21) Appl. No.: 10/169,895

(22) PCT Filed: Nov. 14, 2001

(86) PCT No.: PCT/FR01/03574

§ 371 (c)(1),
(2), (4) Date: Oct. 15, 2002

(87) PCT Pub. No.: WO02/41292

PCT Pub. Date: May 23, 2002

(65) Prior Publication Data

US 2003/0107327 A1 Jun. 12, 2003

(51) Int. Cl.
*G09G 3/10* (2006.01)

(52) U.S. Cl. ..... 315/169.3; 315/169.4; 345/76; 345/77

(58) Field of Classification Search ..... 315/169.3, 315/169.4; 345/76, 77
See application file for complete search history.

(56) References Cited

U.S. PATENT DOCUMENTS 4,492,957 A 1/1985 Marentic
4,496,879 A 1/1985 Suste
4,550,274 A 10/1985 Weber
5,081,400 A * 1/1992 Weber et al. ..... 315/169.4
5,909,199 A 6/1999 Miyazaki et al.
6,642,663 B1 * 11/2003 Okamura et al. ..... 315/169.3

OTHER PUBLICATIONS

International Search Report from application No. PCT/FR 01/03574.

* cited by examiner

*Primary Examiner*—David Vu
(74) *Attorney, Agent, or Firm*—Lisa K. Jorgenson; James H. Morris; Wolf, Greenfield & Sacks, P.C.

(57) ABSTRACT

The invention concerns a drive circuit for a plasma panel consisting of cells arranged at the intersections of lines and columns, comprising, for each column of the panel, a column drive unit (14') for selecting the column by applying a voltage window, the column having a different capacitance (C2) depending on whether or not the neighboring columns are selected, each drive unit (14') comprising first elements (T1, C, CS1) for changing the capacitance in a first predetermined time interval during the low-to-high transition of the voltage window, and second elements (T2, 28) for discharging said capacitance in a second predetermined time interval during the high-to-low transition of the voltage window, the second elements being controlled on the basis of an estimation of the capacitance obtained from data (Qi−1, Qi+1) indicating whether or not the neighboring columns of said columns have been selected.

20 Claims, 5 Drawing Sheets

| E28 | Qi-1 | Qi | Qi+1 | O28 |
|---|---|---|---|---|
| 0 | * | * | * | 0 |
| 1 | * | 0 | * | 1 |
| 1 | 0 | 1 | 0 | Vmax |
| 1 | 1 | 1 | 0 | Vmed |
| 1 | 0 | 1 | 1 | Vmed |
| 1 | 1 | 1 | 1 | Vmin |

Fig 5

CONTROL CIRCUIT DRIVE CIRCUIT FOR A PLASMA PANEL

BACKGROUND OF THE INVENTION

The present invention relates to plasma screens and more specifically to the control of cells of a plasma screen.

1. Field of the Invention

A plasma screen is an array type of screen, formed of cells arranged at the intersections of lines and columns, a cell includes a cavity filled with a rare gas, and at least two control electrodes. To create a light point on the screen by using a given cell, the cell is selected by applying a potential difference between its control electrodes, after which the cell gas is ionized, generally by means of a third control electrode. This ionization goes along with an emission of ultraviolet rays. The creation of the light point is obtained by excitation of a red, green, or blue luminescent material by the ultraviolet rays.

2. Discussion of the Related Art

FIG. 1 shows a conventional structure of a plasma screen formed of cells 2. Each cell 2 has two control electrodes (not shown) respectively connected to a line 4 and to a column 6. Each cell 2 is represented by its equivalent capacitor. A line control circuit 8 includes, for each line 4, a line activation/deactivation block 10 having an output connected to the considered line. A column control circuit 12 includes, for each column 6, a column control block 14 having an output terminal O connected to the considered column 6. Each block 14 includes an input terminal E. Circuit 12 also includes a storage register 16 connected to receive column control signals (COL) from means not shown. Register 16 includes as many Q outputs as there are blocks 14. Each Q output is coupled to input terminal E of a block 14 via a logic switch 18. All logic switches 18 (here, AND gates) are controlled by the same enable signal VAL, provided by means not shown. Circuits 8 and 12 are conventionally integrated on the same semiconductor chip of a control circuit.

Conventionally, the cells of a plasma screen are activated line by line. The non-activated lines are submitted to a quiescent voltage (for example, 150 V). The activated line is brought to an activation voltage (for example, 0 V), the columns being at a deactivation voltage GND (0 V). Then, to activate selected cells in the activated line, the corresponding columns are brought from deactivation voltage GND to an activation voltage VPP (80 V) for a predetermined duration. Thus, the columns corresponding to the selected cells are each submitted to a voltage square pulse of the same amplitude and of same amplitude and the same duration. The columns corresponding to the unselected cells of the activated line are maintained at voltage OND. Thus, the cells to be activated are submitted, during the voltage square pulse, to a column-line voltage equal to VPP-GND (80 V). All non-activated lines are at the quiescent voltage (150 V). The column voltage being either 0 V or 80 V, the cells of the non-activated lines are reverse biased and are not submitted to a voltage capable of starting the gas ionization.

FIG. 2 shows a conventional column control block 14. An N-type MOS transistor T1 has its drain connected to voltage VPP and its source connected to output terminal O. An N-type MOS transistor T2 has its drain connected to output terminal O and its source connected to voltage GND. A zener diode 20 is connected by its cathode to the gate of transistor T1 and by its anode to the source of transistor T1. A P-type MOS transistor T3 has its source connected to voltage VPP and its drain connected to the gate of transistor T1. An N-type MOS transistor T4 has its drain connected to the gate of transistor T1 and its source connected to ground (GND). P-type MOS transistors T5, T6 have their sources connected to voltage VPP. The gate of transistor T5 is connected to the drain of transistor T6 and the gate of transistor T6 is connected to the drain of transistor T5. An N-type MOS transistor T7 has its source connected to ground and its drain connected to the drain of transistor T5. An N-type MOS transistor T8 has its source connected to ground and its drain connected to the drain of transistor T6. The gate of transistor T3 is connected to the drain of transistor T6. The gates of transistors T2, T4, and T7 are connected to input terminal E via an inverter 22. The gate of transistor T8 is connected to the output of inverter 22 via an inverter 24. Output terminal O is connected to a column 6. In FIG. 2, a capacitor C2 connects column 6 to ground. Capacitor C2 is the equivalent capacitor of column 6. It is mainly formed of a first component corresponding to the capacitance between the selected column and the screen lines, and of a second component corresponding to the capacitance between the selected column and its neighboring lines. Capacitance C2 does not have a constant value, as will be seen hereafter.

Block 14 is provided to submit column 6 to a voltage square pulse when its input E receives a logic "1" (for example, a voltage VDD equal to 5 V), then a logic "0" (0 V). When input E receives a logic "1", block 14 charges capacitor C2 to a voltage substantially equal to VPP (which will be called VPP for simplicity). When input E receives a logic "0", block 14 discharges capacitor C2 and the voltage of column 6 switches from VPP to GND. The value of the capacitor C2 of a column 6 depends on the voltages to which the neighboring columns located on either side of this column 6 are submitted. Thus, when a column 6 is submitted to the voltage square pulse, the capacitor C2 of this column has a maximum value if none of the two neighboring columns is submitted to a voltage square pulse. Capacitor C2 has a minimum value if the two neighboring columns are submitted to a voltage square pulse, and a value substantially equal to half of the sum of the maximum and minimum values, which will be called hereafter the median value, if only one of the neighboring columns is also submitted to a voltage square pulse.

It is important for the proper operation of a plasma screen that the rise and fall times of the voltage square pulse provided to each selected column be smaller than a predetermined maximum duration. The maximum rise time of the voltage square pulse may be different from the maximum fall time of the voltage square pulse. For simplicity, they will be assumed to be equal. The maximum admissible rise/fall duration of the voltage square pulse and the different values of capacitance C2 are features of each type of plasma screen. For a given type of screen, blocks 14 are provided, to each provide (and receive) a predetermined current enabling charging (and discharging) the capacitor C2 with the maximum capacitance of he considered screen type in a time shorter than the maximum admissible rise/fall duration of the voltage square pulse for this type of screen. Especially, transistors T1 and T2 are sized to conduct this predetermined current when on.

However, when capacitance C2 has its median value or its minimum value, the rise/fall durations of the voltage square pulse are shorter than the rise/fall durations observed for the maximum capacitance C2. Accordingly, block 14 provides or absorbs the preceding predetermined current for a variable duration depending on the selection of the neighboring columns. As a result, each block 14 introduces, when capacitance C2 has its minimum value, intense variations in the current consumption for very short durations, which may create electromagnetic disturbances on the power supply and the ground of the control circuit, which is not desirable.

Further, a control circuit having its blocks 14 sized to control a screen of a specific type may not be usable to control another type of screen.

SUMMARY OF THE INVENTION

An object of the present invention is to provide a circuit for controlling cells of a plasma screen having an operation which is rather unlikely to create electromagnetic disturbances.

Another object of the present invention is to provide such a control circuit which can easily be adapted to various types of plasma screens.

To achieve these and other objects, the present invention provides a circuit for controlling a plasma screen formed of cells arranged at the intersections of lines and columns, including, for each screen column, a column control block enabling selection of the column associated therewith by applying to said column a voltage square pulse during which said column is brought to a first voltage substantially equal to a first predetermined voltage, then to a second voltage substantially equal to a second predetermined voltage, said column having a different capacitance according to whether the neighboring columns are selected or not, each column control block including a first means adapted to charging the capacitor of said column in a first predetermined duration when said column is brought to said first voltage, and a second means for discharging the capacitor of said column in a second predetermined duration when said column is brought to said second voltage, the second means is controlled by a control means as a function of an estimation of the capacitance of said column obtained from data indicating the selection of the non-selection of the columns adjacent to said columns.

The foregoing and other objects, features and advantages of the present invention will be discussed in detail in the following non-limiting description of specific embodiments, in conjunction with the accompanying drawings, in which:

BRIEF DESCRIPTION OF THE DRAWINGS

FIG. 5 schematically illustrates the operation of the control means of FIG. 3;

DETAILED DESCRIPTION

The present invention provides a control circuit in which each column control block includes means for having the rise and/or fall time of the voltage square pulse provided to each column take a same predetermined value whatever the value of the capacitor of said column.

The same references represent the same elements in the different drawings. Only those elements necessary to the understanding of the present invention have been shown in the following drawings.

Figure 1:
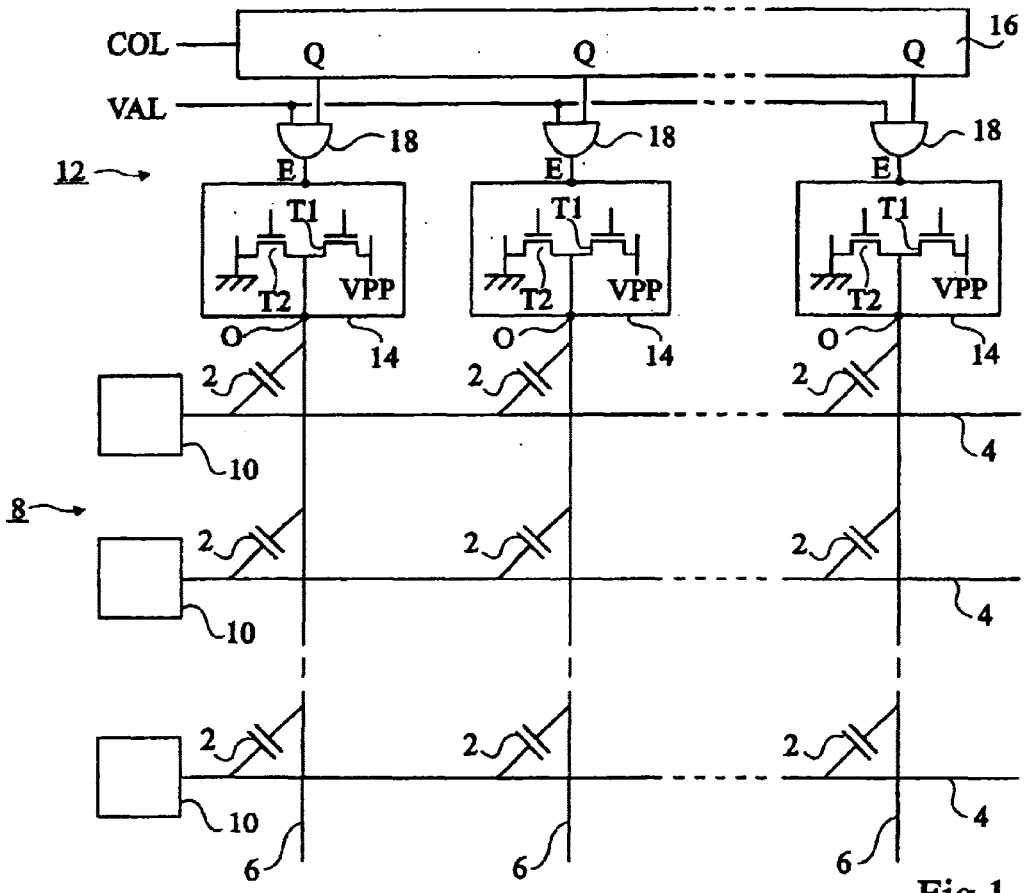
Fig 1 (Prior Art)
FIG. 1, previously described, schematically shows a plasma screen provided with a control circuit.
Figure 2:
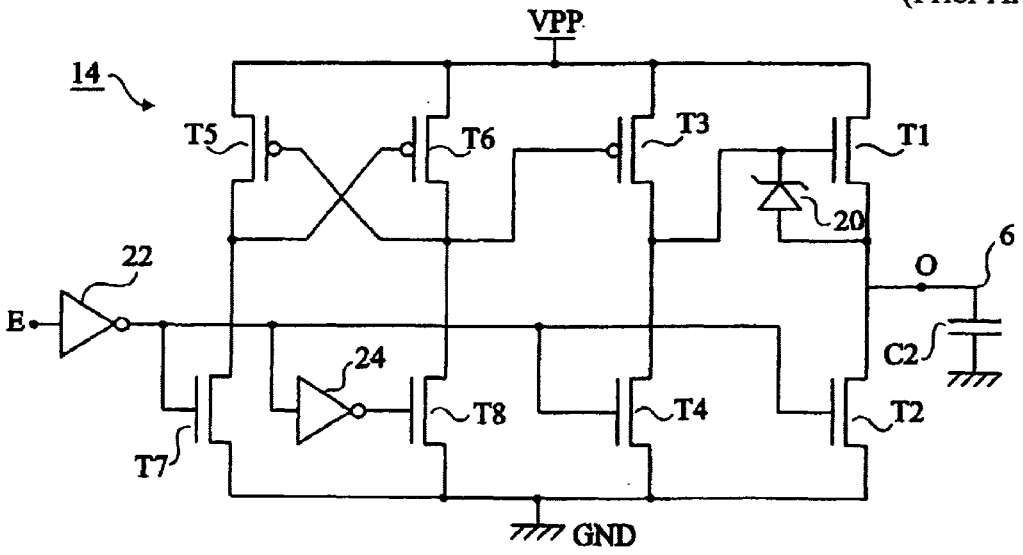
Fig 2 (Prior Art)
FIG. 2, previously described, schematically shows a conventional column control block of a control circuit.
Figure 3:
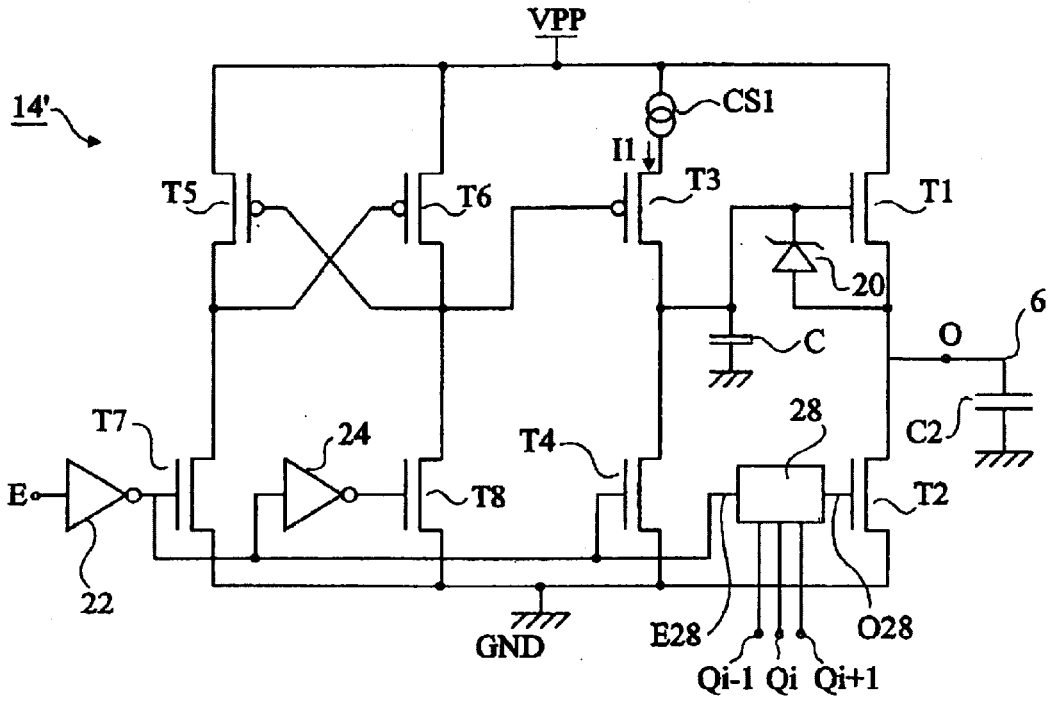
FIG. 3 schematically shows a first embodiment of a column control block according to the present invention.

FIG. 3 shows a column control block 14' according to a first embodiment of the present invention. Block 14' has an output terminal O connected to a column 6. Column 6 is grounded via a capacitor C2. Block 14' includes transistors T1, T2, T3, T4, T5, T6, T7, and T8 and inverters 22 and 24 substantially connected as in FIG. 2. Further, according to the present invention, a capacitor C is connected between the gate of transistor T1 and the ground. A constant current source CS1 has a first terminal connected to voltage VPP and a second terminal connected to the source of transistor T3. The gate of transistor T2 is connected to an output terminal O28 of a control means 28. Control means 28 has an input terminal E28 connected to the output of inverter 22.

When input terminal E receives a logic "1", transistors T7, T6, and T4 turn off, transistors T8, T5, and T3 turn on and the current I1 provided by constant current source CS1 charges capacitor C. It is assumed that at the beginning, capacitor C is discharged. The charge of capacitor C occurs at constant current and the gate voltage of transistor T1 changes from 0 to a maximum value (substantially VPP) in a constant duration. Transistor T1 is connected as a voltage follower. The voltage of output terminal O increases with the gate voltage of transistor T1, in a constant duration, whatever the value of capacitor C2 of column 6. The rise time of the voltage square pulse thus is constant.

Figure 4:
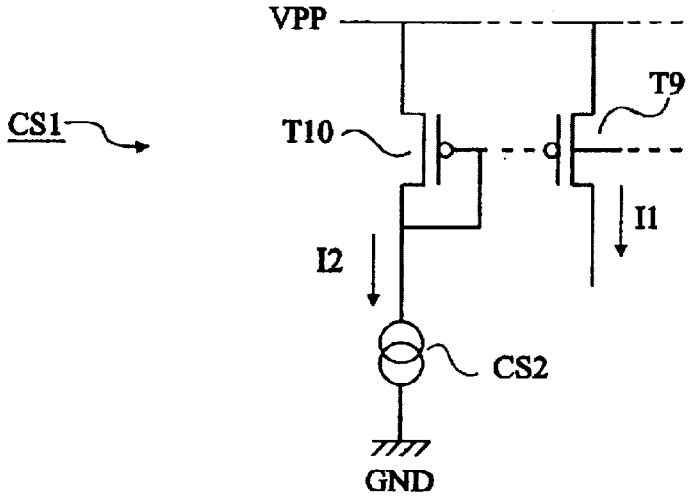
FIG. 4 schematically shows an element of the control block of FIG. 3.

FIG. 4 schematically shows an embodiment of current source CS1 of FIG. 3. Current source CS1 includes a P-type MOS transistor T9, having its source connected to voltage VPP and its drain connected to the source of transistor T3. A P-type MOS transistor T10 has its source connected to voltage VPP and its drain connected to its gate. The gate of transistor T9 is connected to the gate of transistor T10 so that the current flowing through transistor T9 is proportional (to simplify, it is considered to be equal) to the current flowing through transistor T10. A constant current source CS2 has a first terminal connected to the drain of transistor T10 and a second terminal connected to ground. Constant current I2 flowing through current source VS2 is reproduced in transistor T9, and determines the value of current I1 generated by current source CS1. Current I2 determines the rise time of the voltage square pulse to which column 6 is submitted. Current source CS2 may be adjustable to provide different constant currents I2 and adjust the rise time of the voltage square pulse to the features of different types of plasma screens. Transistor T10 and current source CS2 may be common to all the current sources CS1 of all the column control blocks 14' of a control circuit. In this case, each block 14' will only include a transistor T9 having its gate connected to the gate of common transistor T10. Further, it is possible to arrange a switch, for example an N-type MOS transistor, between current source CS2 and transistor T10. Such a switch would enable deactivating of current source CS1 when block 14' is not desired to be used, for example, in a screen ionization hold phase, and thus to limit the consumption of the control circuit.

When input terminal E of the column control block receives a logic "0", transistors T8, T5, T3, and T1 turn off and transistors T&, T6, and T4 turn on. Control means 28 is activated and it submits the gate of transistor T2 to an activation voltage selected from among three predetermined activation voltages. According to the present invention, the activation voltage provided by means 28 is different according to whether the value of capacitor C2 is maximum, median, or minimum, so that transistor T2 is respectively conducts a maximum, median, or minimum current and that the discharge duration of capacitor C2 is constant. Control means 28 includes three control terminals $Q_i$, $Q_{i-1}$, $Q_{i+1}$. Terminal $Q_i$ is connected to the Q output of register 16, which is coupled to input E of control block 14' of the considered column 6, said to be of rank i. Terminal $Q_{i-1}$ is connected to the Q output of register 16, which is coupled to control block 14' of the preceding column, of rank i−1. Terminal $Q_{i+1}$ is connected to output Q of register 16, which is coupled to the control block 14' of the next column, of rank i+1.

FIG. 5 illustrates the operation of control means 28 of FIG. 3. When input terminal E28 receives a logic "0", block 14' controls the rising of the voltage square pulse and output terminal O28 is grounded to turn transistor T2 off. When input terminal E28 receives a logic "1" and when terminal $Q_i$ receives a logic "0", the column 6 coupled to control block 14' is not selected. Output terminal O28 then takes a logic value "1", transistor T2 is turned on and connects capacitor C2 to ground. When input terminal E28 receives a logic "1" and terminal $Q_i$ receives a logic "1", and terminal $Q_{i-1}$ and $Q_{i+1}$ receives a logic "0" (none of the columns neighboring column 6 is selected), output O28 is brought to a voltage $V_{max}$. When input terminal E28 receives a logic "1", terminal $Q_{i-1}$receives a logic "1" and only one of terminals $Q_{i-1}$ and $Q_{i+1}$ receives a logic "0" (only one of the columns next to column 6 is selected), output O28 is brought to a voltage $V_{med}$. When input terminal E28 receives a logic "1", and terminals $Q_{i-1}$ and $Q_{i+1}$ receive a logic "1" (the two columns next to column 6 are also selected), output O28 is brought to a voltage $V_{min}$. Voltages $V_{max}$, $V_{med}$, and $V_{min}$, smaller than voltage VDD, are chosen to control transistor T2 so that it is respectively run through by currents $I_{max}$, $I_{med}$, and $I_{min}$ adapted to discharging capacitor C2 from voltage VPP to ground in a constant time, when capacitance C2 respectively has its maximum, median, and minimum value.

It should be noted that voltages $V_{max}$, $V_{med}$, and $V_{min}$ can be generated by adjustable voltage sources, to adapt the control circuit to different types of plasma screens.

Figure 6:
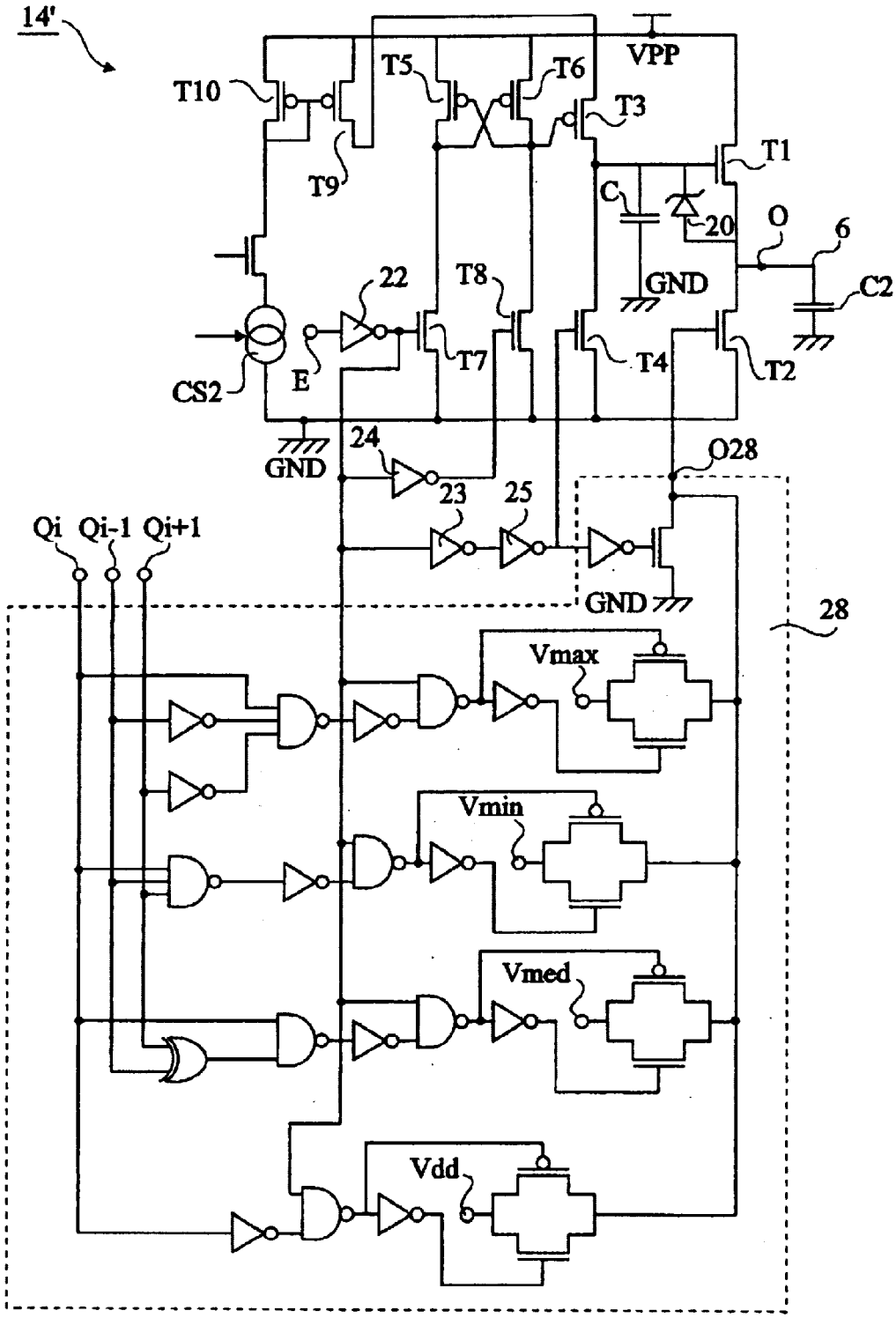
FIG. 6 shows in more detail an example of forming of the control block of FIG. 3.

FIG. 6 shows in further detail an example of a structure of control block 14'. In FIG. 6, means 28 is formed by means of inverters, of NAND, X-OR gates, and of transistors assembled as switches, but those skilled in the art will easily form a means 28 having the same functions by means of other elements. Further, in FIG. 6, the gate of transistor T4 is connected at the output of inverter 22 via two series-connected inverters 23, 25.

Figure 7:
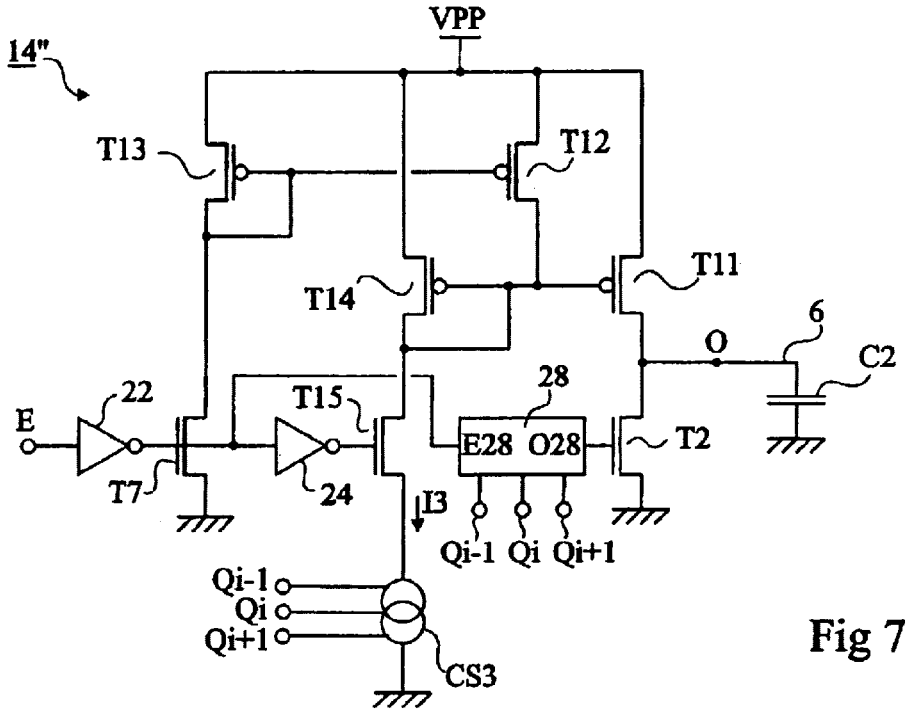
FIG. 7 schematically shows a second embodiment of a column control block according to the present invention.

FIG. 7 schematically shows a column control block 14" according to a second embodiment of the present invention. Block 14" includes an input terminal E and an output terminal O. Block 14" includes a P-type MOS transistor T11, having its source connected to voltage VPP and its drain connected to terminal O. An N-type MOS transistor T2 has its source connected to ground and its drain connected to the drain of transistor T11. The gate of transistor T2 is connected to output O28 of a control means 28 having three control terminals Qi, $Qi_{-1}$, and $Q_{i+1}$. Terminals Qi, $Qi_{-1}$, $Q_{i+1}$ are connected to register 16 as described in relation with FIG. 3. Means 28 has an input terminal E28 connected to terminal E via an inverter 22. A P-type MOS transistor T12 has its source connected to voltage VPP and its drain connected to the gate of transistor T11. Transistor T12 forms a current mirror with a P-type MOS transistor T13 having its source connected to voltage VPP and having an interconnected drain and source. The drain of transistor T13 is connected to the drain of an N-type transistor T7 having its source connected to ground and its gate connected to the output of inverter 22. A P-type MOS transistor T14 has its source connected to the drain of an N-type MOS transistor T15, having its gate connected via an inverter 24 to the output of inverter 22. A variable current source CS3 has a first terminal connected to the source of transistor T15 and a second terminal connected to ground. Current source CS3 has a first terminal connected to the source of transistor T15 and a second terminal connected to ground. Current source CS3 includes three control terminals connected to the terminals Qi, $Qi_{-1}$, and $Q_{i+1}$ Current source CS3 is provided to provide a current I3 capable of having three different values $I3_{max}$, $I3_{med}$, and $I3_{min}$ according to the values of the signals received on terminals Qi, $Qi_{-1}$, and $Q_{i+1}$. The current flowing through transistor T11, proportional to current I3 running through current source CS3, determines the rise time of the voltage square pulse provided to column 6.

When input terminal E of the column control block is at a logic "0", transistors T7, T13, and T12 are on, transistors T15, T14, and T11 are off and means 28 is activated. As in the preceding block 14', control means 28 is controlled according to the Q outputs of register 16 and it submits the gate of transistor T2 to an activation voltage selected from among three predetermined voltages, so that the discharge duration of capacitor C2 is constant.

When input terminal E receives a logic "1", transistors T7, T12, T13, and T2 are off and transistors T15, T14 and T11 are on. The current flowing through transistor T11 charges capacitor C2. The three currents I3max, I3med, and I3min are adapted to ensuring a predetermined constant rise duration of the voltage square pulse when capacitance C2 respectively has its maximum, median and minimum value.

Figure 8:
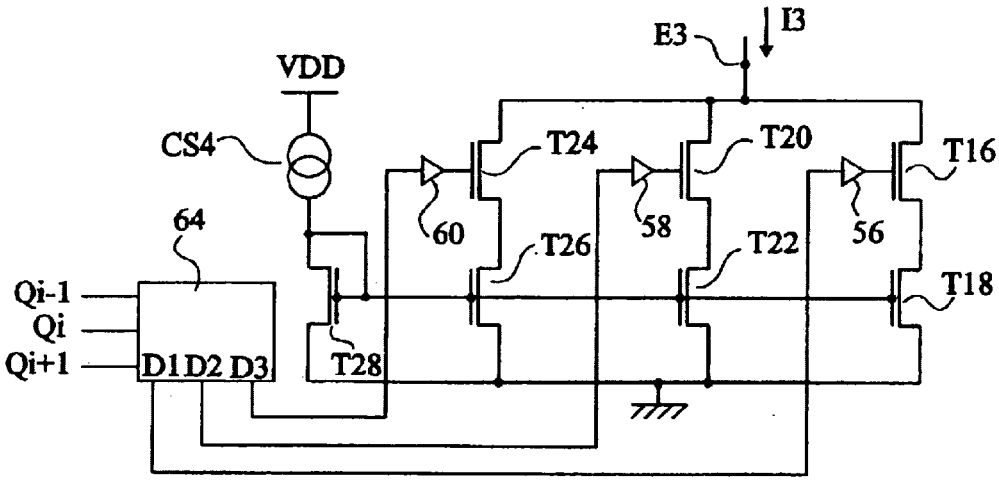
FIG. 8 schematically shows the variable current source of FIG. 7.

FIG. 8 very schematically shows an embodiment of current source CS3 of FIG. 7. Current source CS3 includes a first terminal E3 connected to the source of transistor T15. An N-type MOS transistor T16 has its drain connected to terminal E3. Transistor T16 is assembled as a switch. The gate of transistor T16 is connected to the output of a buffer circuit 56. An N-type MOS transistor T18 has its drain connected to the source of transistor T16 and its source connected to ground. An N-type MOS transistor T20 has its drain connected to terminal E3. Transistor T20 is assembled as a switch. The gate of transistor T20 is connected to the output of a buffer circuit 58. An N-type MOS transistor T22 has its drain connected to the source of transistor T20 and its source connected to ground. An N-type MOS transistor T24 has its drain connected to terminal E3. Transistor T24 is assembled as a switch. The gate of transistor T24 is connected to the output of a buffer circuit 60. An N-type MOS transistor T26 has its drain connected to the source of transistor T24 and its source connected to ground. An N-type MOS transistor T28 has its source connected to ground and its drain connected to supply voltage VDD via a constant current source CS4. The gate and drain of transistor T28 are interconnected. The gates of transistors T26, T22, and T18 are connected to the gate of transistor T28. Transistors T26, T22, and T18 each behave as a constant current source. A decoder 64 has three outputs D1, D2, and D3 respectively connected to control buffer circuits 56, 58, and 60. Decoder 64 has three input terminals corresponding to control terminals $Q_{i-1}$, $Q_i$, and $Q_{i+1}$ of constant current source CS3.

The operation of decoder 64 is the following. When only terminal $Q_i$ is at "1", output D3 is at "1" and outputs D2, D1 are at "0". When terminal $Q_i$ and only one of terminals $Q_{i-1}$ and $Q_{i+1}$ are at "1", output D2 is at "1" and outputs D3, D1 are at "0". When terminals $Q_i$, $Q_{i-1}$, and $Q_{i+1}$ are at "1", output D1 is at "1" and outputs D3, D2 are at "0".

Transistor T24 is on and transistors T20 and T16 are off when capacitance C2 has a maximum value. Transistor T20 is on and transistors T24 and T16 are off when capacitor C2 has a median value. Transistor T16 is on and transistors T24 and T20 are off when capacitance C2 has a minimum value. The channel width and length of transistors T26, T22, and T18 are provided in such a way that these transistors are respectively run through by currents I3max, I3med, and I3min. Current source CS4 may be fixed, or may be adjustable to adjust the rise time of the voltage square pulse to different types of plasma screens.

The present invention is likely to have various alterations, modifications, and improvements which will readily occur to those skilled in the art. In particular, the elements used to form column control blocks 14' and 14" are given as an example only, and those skilled in the art will easily adapt the present invention to other embodiments using other elements having equivalent functions. For example, the MOS transistors may be replaced with bipolar transistors.

Further, in the described embodiments, column control blocks 14' and 14" provide voltage square pulses having constant rise and fall times. However, these two aspects may be dissociated from each other and it is possible to provide a column control block providing voltage square pulses in which only the rise time is constant or only the fall time is constant, without departing from the field of the present invention.

Moreover, the described embodiments apply to plasma screens in which the capacitor C2 of each column 6 can take three values, only the influence of the columns adjacent to the selected column having been considered. Of course, the influence of other columns neighboring the selected column may be taken into account, those skilled in the art easily adapting the present invention to the case where capacitance C2 can take more than three values.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A control circuit for controlling a plasma screen formed of cells arranged at the intersections of lines and columns, including, for each screen column, a column control block enabling selection of the column associated therewith by applying to said column a voltage square pulse during which said column is brought to a first voltage substantially equal to a first predetermined voltage, then to a second voltage substantially equal to a second predetermined voltage, said column having a different capacitance according to whether the neighboring columns are selected or not, wherein each column control block includes means adapted to charging the capacitor of said column in a first predetermined duration regardless of the value of said capacitance when said column is brought to said first voltage.

2. The control circuit of claim 1, wherein said means includes; a first transistor, enabling flowing of a current in said column, a second transistor connected to form, with the first transistor, a current mirror, the current flowing through the second transistor determining the current flowing through the first transistor, and a first current source, the current provided by the first current source passing through the second transistor and taking a value which depends on an estimation of the column capacitance obtained from information, so that the current passing through the first transistor charges the capacitor of said column for the predetermined duration.

3. The control circuit of claim 2, wherein the first current source is further adsjustable to adjust the charge time of the capacitor of said column.

4. The control circuit of claim 1, wherein said means includes a third transistor connected as a voltage follower enabling flowing of a current for charging the capacitor of said column, the third transistor receiving on its control terminal a voltage switching from the second voltage to the first voltage during said predetermined duration.

5. The control circuit of claim 4, wherein said means includes a capacitor between the control terminal of the third transistor and the second voltage, and a second current source connected between the first voltage and the control terminal of the third transistor, adapted to providing a constant current to said capacitor and charging said capacitor during said predetermined duration.

6. The control circuit of claim 5, wherein the second current source is adjustable to adjust a charge time of said capacitor, and wherein the second current source includes a fourth transistor connected to provide the charge current of said capacitor, a fifth transistor connected to form, with the fourth transistor, a current mirror, the current flowing through the fifth transistor determining the current flowing through the fourth transistor, and a third current source connected to set the current flowing through the fifth transistor, the fifth transistor and the third current source being possibly common to all column control blocks of the plasma screen, and a switch being connectable in series with the third current source to deactivate the plasma screen.

7. The control circuit of claim 1, further comprising a second means for discharging the capacitor of said column in a second predetermined duration when said column is brough to said second voltage, the second means being controlled by a control means as a function of an estimation of the capacitance of said column obtained from data indicating the selection or the non-selection of the columns adjacent to said column.

8. The control circuit claim 7, wherein the second means includes a sixth transistor, enabling flowing of a current for discharging the capacitor of said column towards the second voltage, the current flowing through the sixth transistor being controlled according to the estimation of the capacitance of said column so that the discharge time of the capacitor of said column corresponds to the second predetermined duration.

9. The control circuit of claim 8, wherein the control means provides the control terminal of the sixth transistor with a control voltage depending on the estimation of the capacitance of said column.

10. The control circuit of claim 9, wherein said control voltage is further adjustable to adjust the discharge time of the capacitor of said column.

11. A circuit for controlling a plasma screen formed of cells arranged at the intersections of lines and columns, including, for each screen column, a column control block enabling selection of the column associated therewith by applying to said column a voltage pulse during which said column is brought to a first voltage, then to a second voltage, said column having a different capacitance according to whether the neighboring columns are selected or not, wherein each column control block comprises circuitry adapted to charge the capacitor of said column for a first predetermined duration when said column is brought to said second voltage, wherein the circuitry adapted to discharge the capacitor is controlled by control circuitry that responds to an estimation of the capacitance of said column obtained from data indicating the selection or the non-selection of the columns adjacent to said column.

12. The control circuit of claim 11, wherein the circuitry adapted to discharge the capacitor includes a first transistor, enabling flowing of a current for discharging the capacitor of said column towards the second voltage, the current flowing through the first transistor being controlled according to the estimation of the capacitance of said column so that the discharge time of the capacitor of said column corresponds to the second predetermined duration.

13. The control circuit of claim 12, wherein the control circuitry provides the control terminal of the first transistor with a control voltage depending on the estimation of the capacitance of said column.

14. The control circuit of claim 13, wherein said control voltage is further adjustable to adjust the discharge time of the capacitor of said column.

15. The control circuit of claim 11, wherein the circuitry adapted to charge the capacitor is controlled as a function of of an estimation of the capacitance of said column obtained from data indicating the selection or the non-selection of the columns neighboring said column.

16. The control circuit of claim 15, wherein the circuitry adapted to charge the capacitance includes:

a second transistor that controls a current in said column, a third transistor connected to form, with the second transistor, a current mirror, the current flowing through the third transistor determining the current flowing through the second transistor, and a first current source, the current provided by the first current source running through the third transistor and taking a value which depends on the column capacitance, so that the current passing through the second transistor charges the capacitor of said column in the first predetermined duration.

17. The control circuit of claim 16, wherein the first current source further adjustable to adjust the charge time of the capacitor of said column.

18. The control circuit claim 1, wherein the circuitry adapted the charge the capacitor includes a fourth transistor connected as a voltage follower enabling flowing of a current for charging the capacitor of said column, the fourth transistor receiving on its control terminal voltage switching from the second voltage during the first predetermined duration.

19. The control circuit of claim 18, wherein the circuitry adapted to charge the capacitor includes a capacitor connected between the control terminal of the fourth transistor and the second voltage, and a second current source connected between the first voltage and the control terminal of the fourth transistor, adapted to providing a constant current to said capacitor and charging it during the first predetermined duration.

20. The control circuit to claim 19, wherein the second current source is adjustable to adjust a charge time of said capacitor, and wherein the second current source is adjustable to adjust a charge time of said capacitor, and wherein the second current source includes a fifth transistor connected to provide the charge current of said capacitor, a sixth transistor connected to form, with the fifth transistor, a current mirror, the current flowing through the sixth transistor determining the current flowing through the fifth transistor, and a third current source connected to set the current flowing through the sixth transistor, the sixth transistor and the third current source being possibly common to all column control blocks of the plasma screen, and a switch being connectable in series with the third current source to deactivate it.

* * * * *

UNITED STATES PATENT AND TRADEMARK OFFICE

CERTIFICATE OF CORRECTION

PATENT NO. : 7,122,968 B2
APPLICATION NO. : 10/169895
DATED : October 17, 2006
INVENTOR(S) : Céline Mas, Gilles Troussel and Eric Benoit It is certified that error appears in the above-identified patent and that said Letters Patent is hereby corrected as shown below:

Column 7, line 62 should read:
the capacitor of said column in a predetermined dura Column 8, line 22 should read:
includes a capacitor connected between the control terminal of the third Column 8, line 28 should read:
The control circuit of claim 2, wherein the second In column 8, line 44 should read:
brought to said second voltage, the second means being Column 8, line 49 should read:
The control circuit of claim 7, wherein the second In column 9, lines 7-8 should read:
predetermined duration when said column is brought to said first voltage, and circuitry adapted to discharge the capacitor of said column for a second predetermined duration when said column is brought to said second voltage, wherein the circuitry adapted to discharge Column 9, line 33 should read:
The control circuit of claim 12, wherein the circuitry In column 10, line 8 should read:
current source is further adjustable to adjust the charge time of Column 10, line 10 should read:
The control circuit of claim 16, wherein the circuitry In column 10, line 11 should read:
adapted to charge the capacitor includes a fourth transistor , lines 14-15 should read
transistor receiving on its control terminal a voltage switching from the second voltage to the first voltage during the first predetermined.

UNITED STATES PATENT AND TRADEMARK OFFICE

CERTIFICATE OF CORRECTION

PATENT NO. : 7,122,968 B2
APPLICATION NO. : 10/169895
DATED : October 17, 2006
INVENTOR(S) : Céline Mas, Gilles Troussel and Eric Benoit It is certified that error appears in the above-identified patent and that said Letters Patent is hereby corrected as shown below:

In column 10 line 24 should read:
The control circuit of claim 19, wherein the second In column 10, claim 20, lines 26-28 should read:
capacitor, and wherein the second current source includes a fifth transistor con- Signed and Sealed this Twenty-sixth Day of December, 2006

JON W. DUDAS
*Director of the United States Patent and Trademark Office*